US007091942B2

(12) United States Patent
Tsuda

(10) Patent No.: US 7,091,942 B2
(45) Date of Patent: Aug. 15, 2006

(54) ELECTROOPTIC DEVICE AND DRIVING METHOD THEREOF

(75) Inventor: Atsunari Tsuda, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 202 days.

(21) Appl. No.: 09/937,561

(22) PCT Filed: Jan. 29, 2001

(86) PCT No.: PCT/JP01/00591

§ 371 (c)(1),
(2), (4) Date: Sep. 27, 2001

(87) PCT Pub. No.: WO01/57838

PCT Pub. Date: Aug. 9, 2001

(65) Prior Publication Data

US 2002/0154103 A1 Oct. 24, 2002

(30) Foreign Application Priority Data

Jan. 31, 2000 (JP) ..... 2000-022909

(51) Int. Cl.
*G09G 3/36* (2006.01)

(52) U.S. Cl. ..... 345/87; 345/88

(58) Field of Classification Search ..... 345/204, 345/205, 214, 206, 55, 690, 72, 87, 88, 90, 345/93, 99; 349/106, 107, 108, 110, 111; 234/63; 358/1.9

See application file for complete search history.

(56) References Cited

U.S. PATENT DOCUMENTS 5,614,962 A * 3/1997 Nagae et al. ..... 348/751
5,801,794 A * 9/1998 Lehureau et al. ..... 349/5
5,877,844 A * 3/1999 Matsumoto ..... 355/35
6,140,983 A * 10/2000 Quanrud ..... 345/55
6,140,996 A * 10/2000 Nobutani et al. ..... 715/856
6,157,429 A * 12/2000 Miyawaki et al. ..... 349/138
6,175,351 B1 * 1/2001 Matsuura et al. ..... 345/98
6,201,591 B1 * 3/2001 Awane et al. ..... 349/151
6,256,079 B1 * 7/2001 Matsushima ..... 349/106
6,297,788 B1 * 10/2001 Shigeta et al. ..... 345/63
6,313,900 B1 * 11/2001 Kawata ..... 349/153

(Continued)

FOREIGN PATENT DOCUMENTS

JP A 61-128290 6/1986

(Continued)

*Primary Examiner*—Richard Hjerpe
*Assistant Examiner*—Abbas Abdulselam
(74) *Attorney, Agent, or Firm*—Oliff & Berridge, PLC

(57) ABSTRACT

The invention provides an electro-optical apparatus with an enhanced visibility of image in the peripheral region of the active display area, and a method of driving such an electro-optical apparatus. The apparatus includes a mask signal generating circuit that constantly outputs a mask signal to display white. A mask controlling circuit usually outputs a control signal MS to turn on an analog switch and turn off an analog switch. Thus, a display signal on a terminal is supplied to a display signal line via the analog switch, whereby an image is displayed on a display panel. Also, the mask controlling circuit, based on a data line driving signal and a scanning line driving signal supplied from a timing pulse generating circuit, detects the timing to drive each of predetermined pixels in the peripheral region of the display panel, and outputs at the timing a control signal to turn off the analog switch and turn on the analog switch. Thus, white is displayed in the peripheral region of the active display area.

14 Claims, 8 Drawing Sheets

U.S. PATENT DOCUMENTS

| | | | | |
|---|---|---|---|---|
| 6,340,961 | B1 * | 1/2002 | Tanaka et al. | 345/63 |
| 6,618,201 | B1 * | 9/2003 | Nishikawa et al. | 359/619 |
| 6,674,436 | B1 * | 1/2004 | Dresevic et al. | 345/472 |
| 6,677,991 | B1 * | 1/2004 | Ito | 348/220.1 |

FOREIGN PATENT DOCUMENTS

| | | | |
|---|---|---|---|
| JP | A 64-15795 | | 1/1989 |
| JP | A 1-285989 | | 11/1989 |
| JP | A 2-8814 | | 1/1990 |
| JP | U 2-117590 | | 9/1990 |
| JP | 07-175429 | * | 7/1995 |
| JP | 08-095532 | * | 4/1996 |
| JP | A 08-95532 | | 4/1996 |
| JP | A 10-187099 | | 7/1998 |
| JP | A 10-240202 | | 9/1998 |

* cited by examiner

ELECTROOPTIC DEVICE AND DRIVING METHOD THEREOF

BACKGROUND OF THE INVENTION

1. Field of Invention

The present invention relates to electro-optical apparatuses, such as liquid crystal display apparatuses, and more particularly, it relates to an electro-optical apparatus in which the display status in a peripheral region of a display screen is enhanced. The invention also relates to a method of driving such an electro-optical apparatus.

2. Description of Related Art

For example, in a transmission-type liquid crystal display apparatus, in order to prevent light leakage of the transmitted light (backlight), a frame-shaped light-blocking film is formed in the peripheral region of pixels on the device substrate, using a black matrix, etc. constituting color filters. The region where images, such as characters and pictures are actually displayed, i.e., the so-called active display area, is defined by the light-blocking film. However, when the region where the light-blocking film is formed is visually observed, as shown in FIG. 9, the region G looks as if it has a black border on the screen. Thus, for example, if a character "E" is displayed at the edge of the active display area L, part of the character overlaps the region of the light-blocking film and becomes indistinguishable, causing a problem that the visibility of the character is considerably degraded.

SUMMARY OF THE INVENTION

The present invention addresses the above problem, and an object thereof is to provide an electro-optical apparatus having enhanced image visibility, particularly in the peripheral region of the active display area, and a method of driving such an electro-optical apparatus.

In order to solve the above-described problem, an electro-optical apparatus is provided which includes a display panel including a plurality of pixels, and a driver that drives each of the pixels of the display panel based on a display signal which is externally supplied. A timing detection device is provided to detect the timing to drive the pixels in the peripheral region of the display. A display controller is provided to output a signal to display a particular color to the driver at the timing detected by the timing detection device.

In accordance with this structure, for example, white is displayed as the particular color in the periphery of the active display area of the display panel. Accordingly, the visibility in the peripheral region of the active display area can be significantly enhanced compared with the conventional art.

Also, an electro-optical apparatus is provided that includes a display panel including a plurality of pixels, and a driver that drives each of the pixels based on display data which is externally supplied corresponding to each of the pixels of the display panel. A display controller is provided that outputs, to the driver, display data to display a particular color as display data to display each of the pixels in the peripheral region of the display panel.

In accordance with this structure, similarly to the above-described invention, the visibility in the peripheral region of the active display area can be significantly enhanced.

Also, an electro-optical apparatus is provided that includes a display panel including a plurality of pixels, a memory which stores display data corresponding to each of the pixels of the display panel, a writing device that writes, to the memory, display data which is externally supplied, and a driver that drives each of the pixels based on the display data in the memory. A display controller is provided to write, to the memory, display data to display a particular color as display data to display each of the pixels in the peripheral region of the display panel.

In accordance with this structure, similarly to the above-described apparatus, the visibility in the peripheral region of the active display area can be significantly enhanced.

Also, an electro-optical apparatus is provided which includes a display panel including a plurality of pixels, a memory which stores display data corresponding to each of the pixels of the display panel, a writing device that writes, to the memory, display data which is externally supplied, and a driver that drives each of the pixels based on the display data in the memory. Display data to display a particular color is stored in advance in a storage area of the memory corresponding to each of the pixels in the peripheral region of the display panel.

In accordance with this structure, similarly to the above-described apparatus, the visibility in the peripheral region of the active display area can be significantly enhanced. In addition, in accordance with this structure, the structure of the writing device that writes data to the memory can be simplified.

Furthermore, in the above-described apparatus, each of the pixels is formed of liquid crystal.

Furthermore, in the above-described apparatus, the particular color is preferably white. Thus, the visibility in the peripheral region of the active display area can be further enhanced compared with other colors.

Also, a method of driving an electro-optical apparatus is provided. The apparatus includes a display panel including a plurality of pixels, and a driver that drives each of the pixels of the display panel based on a display signal which is externally supplied. The method includes detecting the timing to drive the pixels in the peripheral region of the display panel, and outputting a signal to display a particular color to the driver at the detected timing.

In accordance with the method, for example, white is displayed as the particular color in the periphery of the active display area of the display panel. Accordingly, the visibility in the peripheral region of the active display area can be significantly enhanced compared with the conventional art.

Also, another method of driving an electro-optical apparatus is provided. The apparatus includes a display panel including a plurality of pixels, and a driver that drives each of the pixels based on display data which is externally supplied corresponding to each of the pixels of the display panel. The method includes outputting display data to display a particular color to the driver as display data to display each of the pixels in the peripheral region of the display panel.

In accordance with this method, similarly to the method described above, the visibility in the peripheral region of the active display area can be significantly enhanced.

Also, another method of driving an electro-optical apparatus is provided. The apparatus includes a display panel including a plurality of pixels, a memory which stores display data corresponding to each of the pixels of the display panel, a writing device that writes, to the memory, display data which is externally supplied, and a driver that drives each of the pixels based on the display data in the memory. The method includes writing display data to display a particular color to the memory as display data to display each of the pixels in the peripheral region of the display panel.

In accordance with this method, similarly to the methods of the above-described inventions, the visibility in the peripheral region of the active display area can be significantly enhanced.

In the above-described methods, the particular color is preferably white. Thus, the visibility in the peripheral region of the active display area can be further enhanced compared with other colors.

DETAILED DESCRIPTION OF PREFERRED EMBODIMENTS

Figure 1:
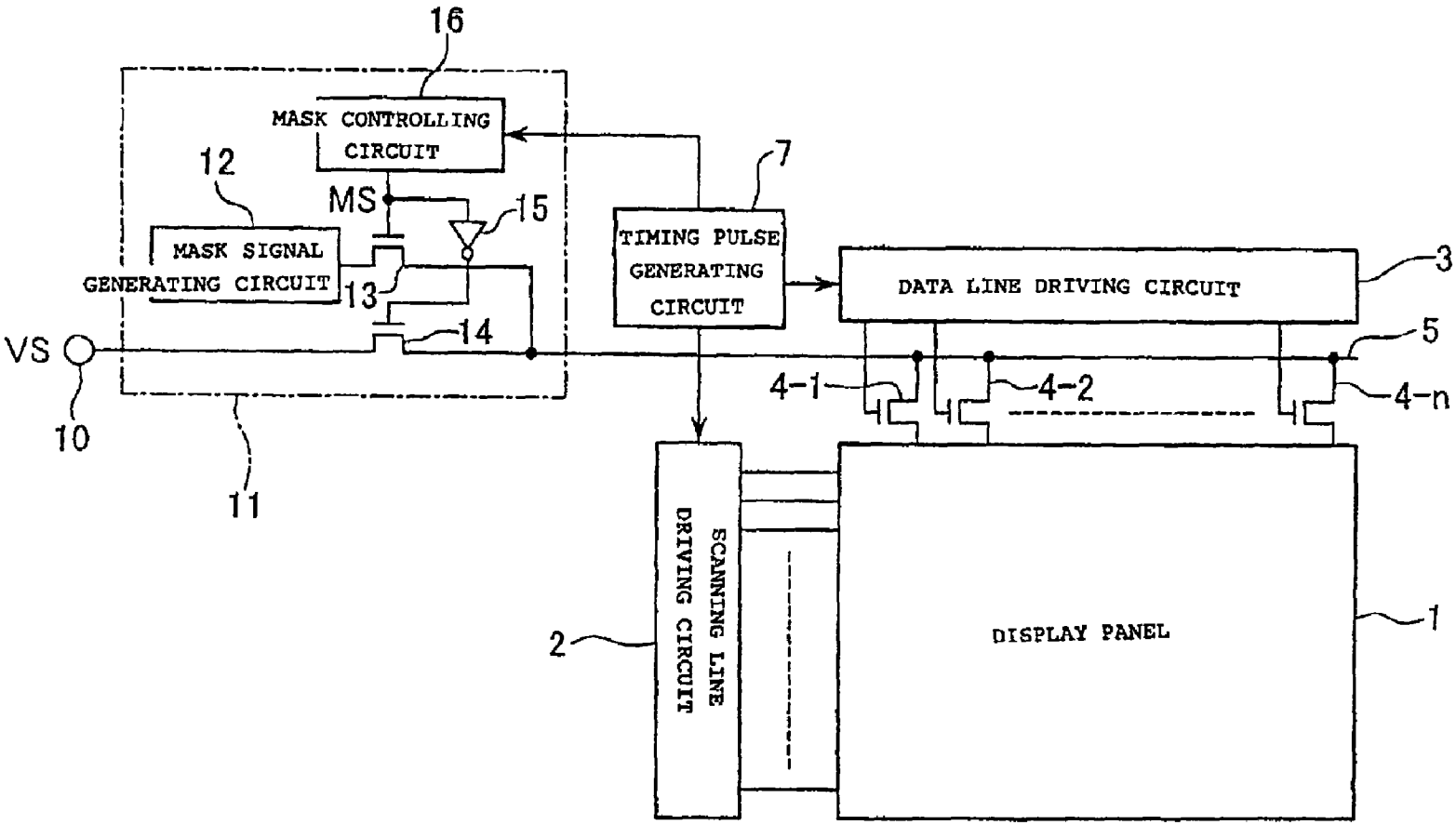
FIG. 1 is a schematic showing the structure of a first embodiment of the present invention.

Embodiments of the present invention will be described below with reference to the drawings. FIG. 1 is a schematic showing the structure of a liquid crystal display apparatus according to a first embodiment of the present invention. FIG. 1 shows a liquid crystal display panel 1 of the active matrix type, a scanning line driving circuit 2 that drives the scanning lines of the display panel 1, and a data line driving circuit 3 that drives the data lines of the display panel 1. Analog switches 4-1, 4-2 . . . **4-*n* are also shown. The source of each of the analog switches 4-1 to 4-*n* is connected to a display signal line 5, the drain thereof is connected to the data line of the display panel 1, and the gate thereof is connected to the data line driving circuit 3**.

A timing pulse generating circuit 7 is also shown, which generates a scanning line driving signal and a data line driving signal based on system clock pulses and outputs respectively to the scanning line driving circuit 2 and the data line driving circuit 3.

In accordance with the above structure, the scanning line driving circuit 2 initially outputs a "H (high)" level signal to the first scanning line (the uppermost scanning line). Then, the data line driving circuit 3 sequentially turns on the analog switches 4-1, 4-2 . . . . Thus, a display signal (analog signal) on the display signal line 5 is sequentially written to each of the pixels on the first line of the display panel 1. Next, the scanning line driving circuit 2 outputs a "H" level signal to the second scanning line of the display panel 1, and then, the data line driving circuit 3 sequentially turns on the analog switches 4-1, 4-2, . . . . Thus, the display signal on the display signal line 5 is sequentially written to each of the pixels on the second line of the display panel 1. Thereafter, the display signal is sequentially written to each of the pixels of the display panel 1 by a similar procedure, whereby an image is displayed. The above-described structure has conventionally been known.

FIG. 1 also shows a terminal 10 to which a display signal (analog signal), which is externally supplied, is supplied, and a white display circuit 11 (display controller). The white display circuit 11 is a circuit that displays white in the peripheral region of the active display area of the display panel 1, and includes a mask signal generating circuit 12, analog switches 13 and 14, an inverter 15, and a mask controlling circuit 16.

The mask signal generating circuit 12 constantly outputs an analog voltage (referred to as a mask signal) to display white. The mask controlling circuit 16 usually outputs a control signal MS to turn on the analog switch 14 and turn off the analog switch 13. Thus, a display signal VS on the terminal 10 is supplied to the display signal line 5 via the analog switch 14, whereby an image is displayed on the display panel 1. Also, the mask controlling circuit 16, based on the data line driving signal and the scanning line driving signal supplied from the timing pulse generating circuit 7, which is timing detection device, detects the timing to drive each of predetermined pixels in the peripheral region of the display panel 1, and outputs at the timing a control signal MS to turn off the analog switch 14 and turn on the analog switch 13.

Figure 2:
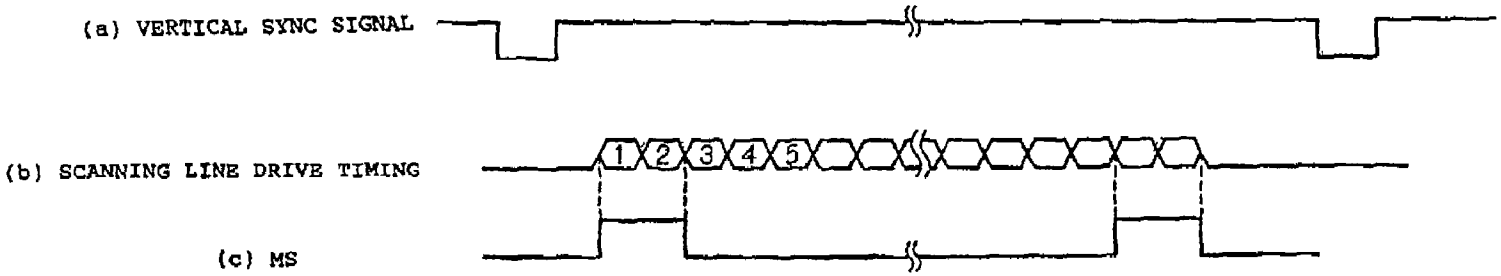
FIG. 2 is a timing diagram for explaining the operation of the embodiment.
Figure 3:
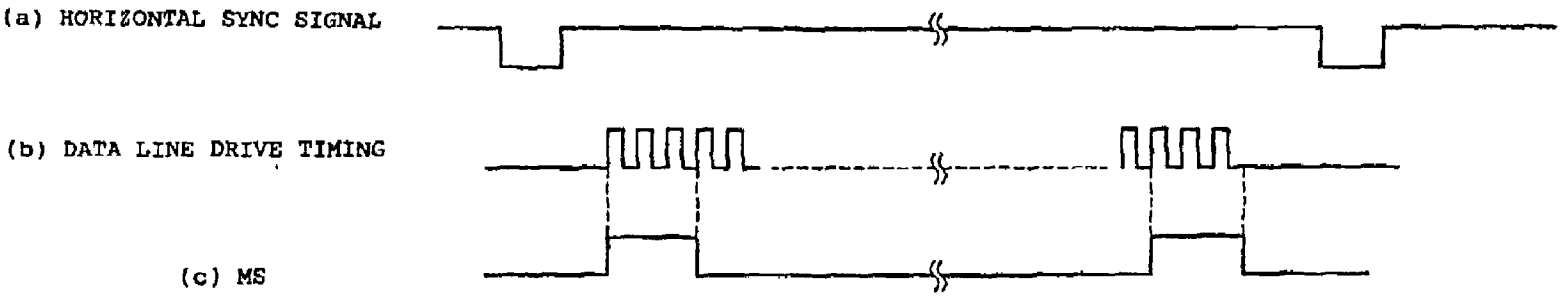
FIG. 3 is a timing diagram for explaining the operation of the embodiment.

More specifically, FIG. 2 shows the vertical sync signal (a), and the scanning line drive timing (b). The numerals 1, 2, . . . in FIG. 2(*b*) indicate numbers of the scanning lines. The mask controlling circuit 16 outputs the control signal MS (c), at the timing to drive a plurality of uppermost scanning lines of the display panel 1, and at the timing to drive a plurality of lowermost scanning lines. Thus, the mask signal is applied to pixels connected to the scanning lines instead of the display signal VS, each of the pixels being displayed in white. Furthermore, FIG. 3 shows the horizontal sync signal (a), and the data line drive timing (b). The mask controlling circuit 16 outputs the control signal MS (c), at the timing to drive a plurality of data lines from the left end and a plurality of data lines from the right end of the display panel 1. Thus, the mask signal is applied to pixels connected to the data lines instead of the display signal VS, each of the pixels being displayed in white.

Figure 4:
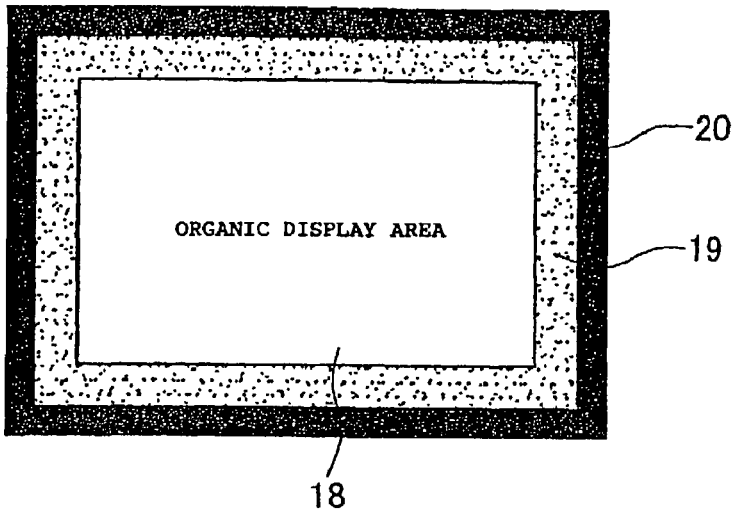
FIG. 4 is a schematic showing a display status of a display panel 1 in the embodiment.

As described above, according to the above-described embodiment, the mask signal is applied to the pixels instead of the display signal VS at the timing to drive each of the pixels in the peripheral region of the display panel 1. Thus, as shown in FIG. 4, a white display area 19 is formed in the periphery of the active display area 18. Accordingly, the visibility in the peripheral region of the active display area 18 can be significantly enhanced compared with the conventional art. FIG. 4 also shows a light-blocking layer 20.

Figure 5:
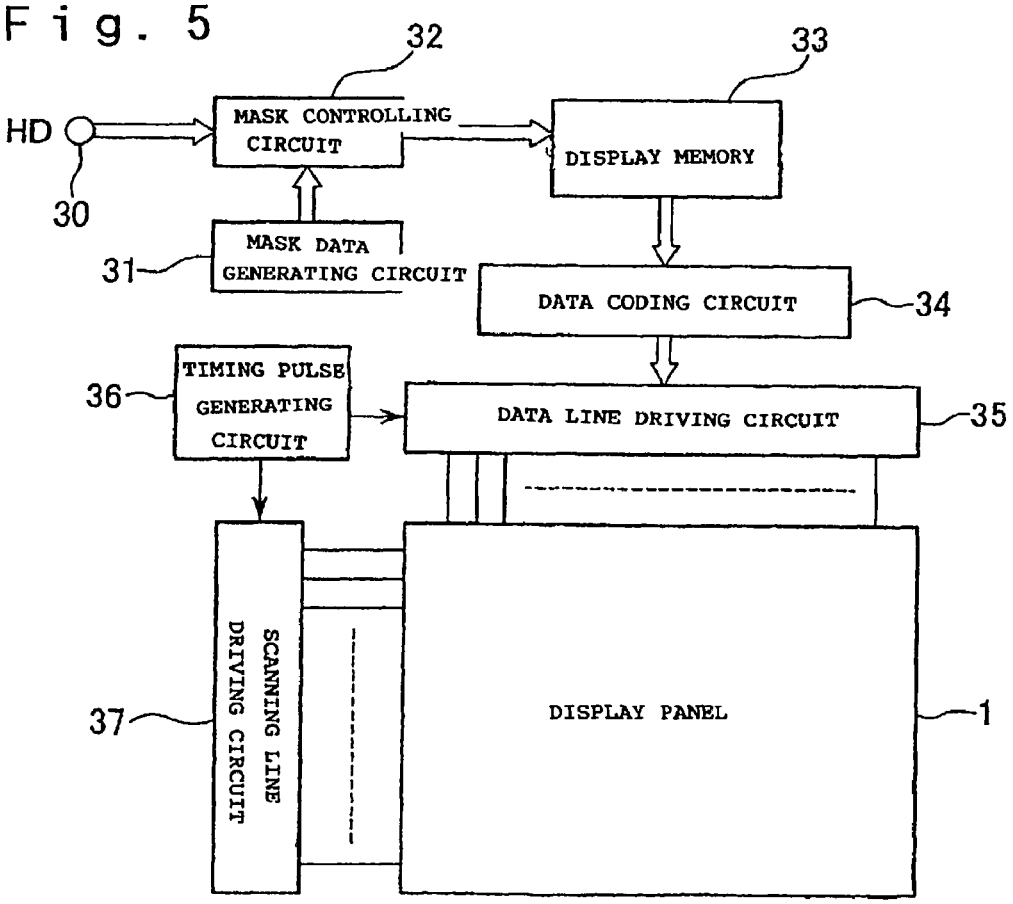
FIG. 5 is a schematic showing the structure of a second embodiment of the present invention.

Next, a second embodiment of the present invention will be described. FIG. 5 is a schematic showing the structure of a liquid crystal display apparatus according to a second embodiment of the present invention. Similarly to the liquid crystal display apparatus according to the above-described first embodiment, the liquid crystal display apparatus shown in FIG. 5 also displays white in the periphery of the active display area of the display panel 1. Furthermore, unlike the above-described apparatus, the liquid crystal display apparatus displays on the display panel 1 in gray scales by digital driving.

FIG. 4 shows a terminal 30 to which display data HD (digital data) is externally supplied, and a mask data generating circuit 31 which constantly outputs mask data. The mask data is digital data (hereinafter referred to as white display data) which instructs display in white. FIG. 5 also shows a mask controlling circuit 32, and a display memory 33. The display memory 33 is a memory which includes memory slots of a number which is the same as the number of the pixels, corresponding to each of the pixels one by one, and is rewritten each time a field is displayed. The mask controlling circuit 32 writes the display data HD to memory slots of the display memory 33 corresponding to the active display area 18 (FIG. 4), while writing the mask data output from the mask data generating circuit 31 to memory slots corresponding to the white display area 19.

A data coding circuit 34 reads out the display data in the display memory, converts each of the display data which has been read out into a pulse width, for example, using a conversion table which is internally provided, and outputs to a data line driving circuit 35. A timing pulse generating circuit 36 generates a scanning line driving signal and a data line driving signal based on system clock pulses, and respectively outputs to a scanning line driving circuit 37 and the data line driving circuit 35.

The scanning line driving circuit 37 outputs an "H" level signal sequentially to the first scanning line (the uppermost scanning line), the second scanning line, the third scanning line . . . , based on the timing of the scanning line driving signal. The data line driving circuit 35 outputs an "H" level signal having a pulse width in accordance with the display data sequentially to the first data line (the leftmost data line), the second data line, the third data line, based on the timing of the data line driving signal.

Figure 6:
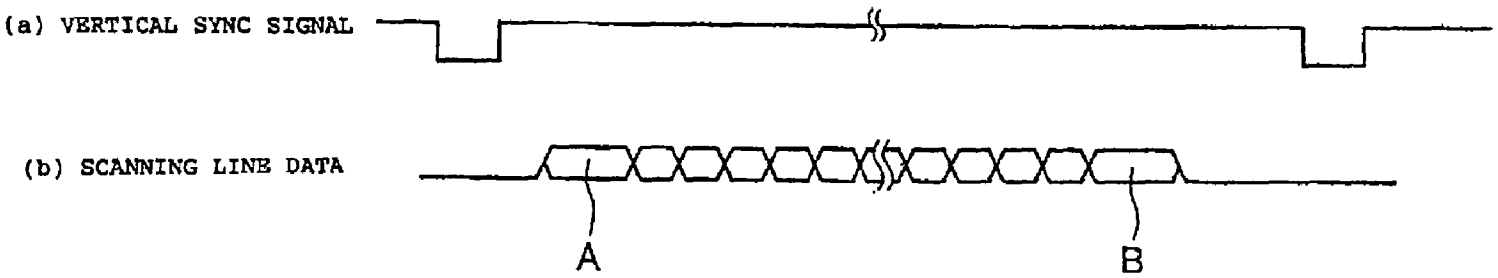
FIG. 6 is a timing diagram for explaining the operation of the embodiment.
Figure 7:
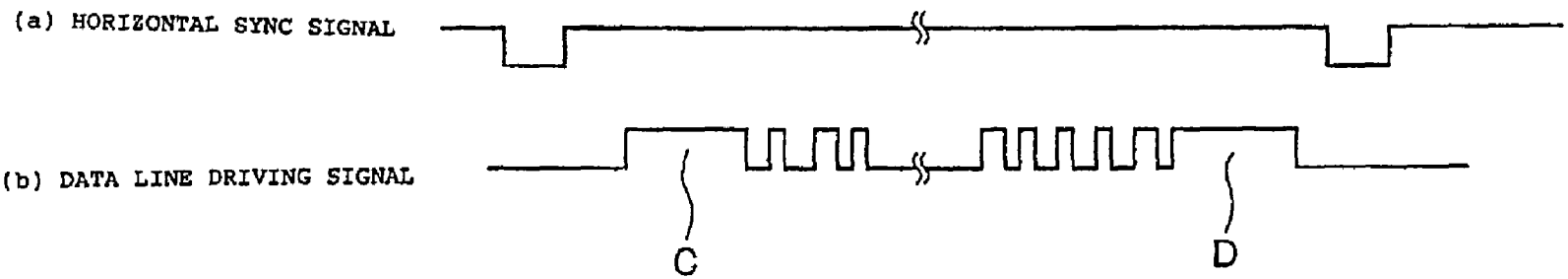
FIG. 7 is a timing diagram for explaining the operation of the embodiment.

FIG. 6 shows the vertical sync signal (a), and the scanning line data (b). As described above, the white display data is written in the display memory 33. Thus, during the time when the plurality of uppermost scanning lines are scanned (indicated in FIG. 6 as A) and during the time when the plurality of lowermost scanning lines are scanned (indicated in FIG. 6 as B), each of the pixels connected to the scanning lines are displayed using the white display data. Furthermore, FIG. 7 shows the horizontal sync signal (a), and the data line driving signal (b). Also, in driving the data lines, the drive signal for the plurality of data lines from the leftmost data line and a plurality of data lines from the rightmost data line is a signal having a pulse width to display white (the longest pulse width) (indicated in FIG. 7 as C and D).

As such, in the above-described embodiment, the white display data is constantly written to the memory slots in the display memory 33 corresponding to the white display area. Thus, similarly to the above-described liquid crystal display apparatus shown in FIG. 1, white color can be displayed in the peripheral region of the display area (see FIG. 4). Accordingly, the visibility in the peripheral region of the active display area can be enhanced.

Although in the above-described embodiment, the white display data is written to the display memory 33 each time the display memory is rewritten, alternatively, the white display data may be written in advance to predetermined memory slots of the display memory 33, so that only the other memory slots are rewritten with the display data each time a field is displayed. In this way, the structure of the mask controlling circuit 32 can be simplified.

Although the description has been directed to cases where the particular color which is displayed by the pixels in the peripheral region of the display area is white, the embodiments do not limit the particular color to white. For example, if the liquid crystal apparatus is a color display including color filters, depending on the display color of characters, etc., the display color, which is displayed by the pixels in the peripheral region of the display area, may be a color which facilitates recognition of the characters. For example, if the characters are displayed in yellow, the characters will be recognized with ease if the particular color which is displayed by the pixels in the peripheral region of the display area is black.

Figure 8:
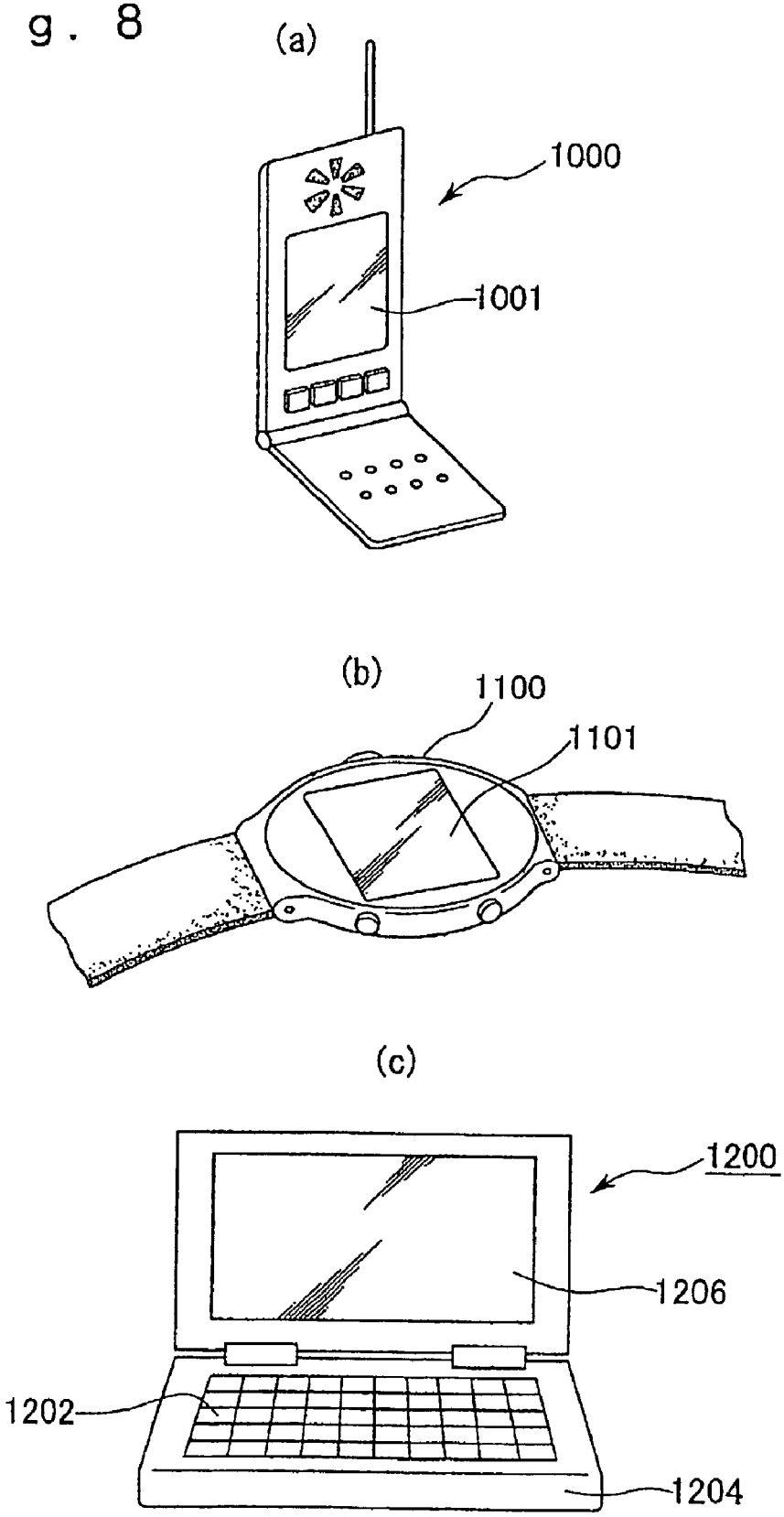
FIGS. 8(*a*)–8(*c*) are perspective views showing examples of electronic equipment incorporating the electro-optical apparatus of the invention.
Figure 9:
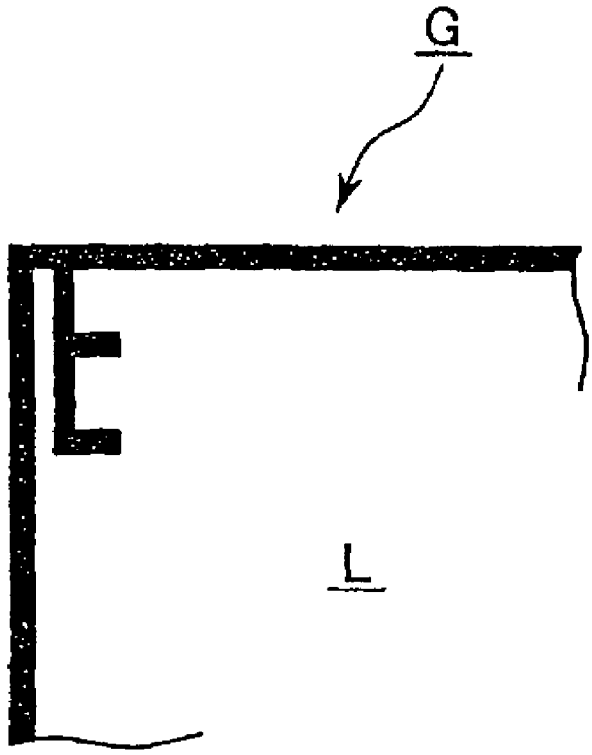
FIG. 9 is a schematic for explaining a problem regarding display in a conventional liquid crystal display apparatus.

FIGS. 8(*a*)–8(*c*) show examples of electronic equipment incorporating the electro-optical apparatus of the invention, in which FIG. 8(*a*) is a perspective view showing a cellular phone. FIG. 8(*a*) shows the main body of the cellular phone 1000 that includes a liquid crystal display unit 1001 using a liquid crystal display apparatus according to the above-described embodiments. FIG. 8(*b*) is a perspective view showing an electronic apparatus of the wristwatch type. FIG. 8(*b*) shows the main body 1100 of the watch, and a liquid crystal display unit 1101 using a liquid crystal display apparatus according to the above-described embodiments. The liquid crystal display apparatus allows display with an enhanced visibility even in the peripheral region compared with a conventional watch display unit, allowing display of television images, and thus achieving a wristwatch-type TV.

FIG. 8(*c*) is a perspective view showing a portable information processing apparatus, such as a word processor or a personal computer. FIG. 8(*c*) shows the information processing apparatus 1200, an input unit 1202, such as a keyboard, a display unit 1206 using a liquid crystal display apparatus according to the above-described embodiments, and the main body 1204 of the information processing apparatus.

As described above, in accordance with the present invention, a particular color (e.g., white) is displayed in the periphery of the active display area of a display panel. Accordingly, the visibility in the peripheral region of the active display area can be significantly enhanced compared with the conventional art.

The invention claimed is:

1. An electro-optical apparatus, comprising:

a display panel including a plurality of pixels in a display area and in a peripheral region around the display area;

a driver that drives each of the pixels of said display panel based on a display signal which is externally supplied;

a timing detection device that detects timing to drive the pixels in the peripheral region of said display panel; and a display controller that, before the externally-supplied display signal is supplied to the driver, applies a mask signal to the display signal at the timing detected by said timing detection device to always display during display operations the same color at pixels in the peripheral region regardless of color indicated for the pixels in the peripheral region by the externally-supplied display signal.

2. The electro-optical apparatus according to claim 1, each of said pixels being formed of liquid crystal.

3. The electro-optical apparatus according to claim 1, said particular color being white.

4. The electro-optical apparatus as claimed in claim 1, wherein the display controller outputs a signal to always display during display operations the pixels in the display area in colors indicated by the externally supplied display signal.

5. An electro-optical apparatus, comprising:

a display panel including a plurality of pixels in a display area and in a peripheral region around the display area;

a driver that drives each of the pixels based on display data which is externally supplied corresponding to each of the pixels of said display panel; and a display controller that, before the externally-supplied display data is supplied to the driver, applies mask data to the display signal to display each of the pixels in the peripheral region of said display panel in the same particular color regardless of color indicated for the pixels in the peripheral region by the externally-supplied display data.

6. The electro-optical apparatus as claimed in claim 5, wherein the display controller stops outputting display data to said driver and enables transfer of the externally supplied display data to the driver to always display during display operations each of the pixels in the display area in the color indicated by the externally supplied display data.

7. An electro-optical apparatus, comprising:

a display panel including a plurality of pixels in a display area and in a peripheral region around the display area;

a memory which stores display data corresponding to each of the pixels of said display panel;

a writing device that writes to said memory display data which is externally supplied;

a driver that drives each of said pixels based on the display data in said memory; and a display control device that, before the externally-supplied display data is supplied to the writing device applies mask data to the display data to always display during display operations each of the pixels in the peripheral region of said display panel in the same particular color regardless of color indicated for the pixels in the peripheral region by the externally-supplied display data.

8. The electro-optical apparatus as claimed in claim 7, wherein the display control device writes to said memory display data to always display during display operations each of the pixels in the display area in the color indicated by the externally supplied display data.

9. An electro-optical apparatus, comprising:

a display panel including a plurality of pixels in a display area and in a peripheral region around the display area;

a memory which stores display data corresponding to each of the pixels of said display panel, the memory including a storage area corresponding to each of the pixels in the peripheral region of said display panel, the storage area being stored with mask data indicating the same particular color for all pixels of the peripheral region of the display panel;

a writing device that writes to said memory display data which is externally supplied; and a driver that, before the externally-supplied display data is supplied to the writing device, applies the mask data to the display data so that each of the pixels in the peripheral region of said display panel are displayed in the same particular color regardless of color indicated for the pixels in the peripheral region by the externally-supplied display data.

10. The electro-optical apparatus as claimed in claim 9, wherein the driver drives each of said pixels so that each of the pixels in the display area is always displayed during display operations in the color indicated by the externally supplied display data.

11. A method of driving an electro-optical apparatus which includes a display panel including a plurality of pixels, and a driver that drives each of the pixels of said display panel based on a display signal which is externally supplied, the method comprising:

detecting timing to drive the pixels in the peripheral region of said display panel; and applying a mask signal to the display signal, before the externally-supplied display signal is supplied to the driver at the detected timing to display the same color at pixels in the peripheral region regardless of color indicated for the pixels in the peripheral region by the externally-supplied display signal.

12. A method of driving an electro-optical apparatus which includes a display panel including a plurality of pixels, and a driver that drives each of the pixels based on display data which is externally supplied corresponding to each of the pixels of said display panel, the method comprising:

applying mask data to the display data, before the externally-supplied display data is supplied to the driver, to always display during display operations each of the pixels in the peripheral region of said display panel in the same particular color regardless of color indicated for the pixels in the peripheral region by the externally-supplied display data.

13. A method of driving an electro-optical apparatus which includes a display panel including a plurality of pixels, a memory which stores display data corresponding to each of the pixels of said display panel, a writing device that writes to said memory display data which is externally supplied, and a driver that drives each of said pixels based on the display data in said memory, the method comprising:

applying mask data to the display data, before the externally-supplied display data is supplied to the writing device, to display the same color at pixels in the peripheral region regardless of color indicated for the pixels in the peripheral region by the externally-supplied display data.

14. The method of driving an electro-optical apparatus according to claim 13, said writing step including writing display data to display a particular color that is white.

* * * * *